US010524506B2

(12) United States Patent
Nakano et al.

(10) Patent No.: US 10,524,506 B2
(45) Date of Patent: Jan. 7, 2020

(54) BURNING TYPE HEAT SOURCE AND FLAVOR INHALER

(71) Applicant: JAPAN TOBACCO INC., Tokyo (JP)

(72) Inventors: Takuma Nakano, Tokyo (JP); Atsuro Yamada, Tokyo (JP); Takeshi Akiyama, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 869 days.

(21) Appl. No.: 14/849,894

(22) Filed: Sep. 10, 2015

(65) Prior Publication Data

US 2015/0374041 A1 Dec. 31, 2015

Related U.S. Application Data

(63) Continuation of application No. PCT/JP2014/056200, filed on Mar. 10, 2014.

(30) Foreign Application Priority Data

Mar. 11, 2013 (JP) ..... 2013-048092
Mar. 11, 2013 (JP) ..... 2013-048093
Mar. 11, 2013 (JP) ..... 2013-048094

(51) Int. Cl.
*A24F 47/00* (2006.01)
*A24B 15/28* (2006.01)
(Continued)

(52) U.S. Cl.
CPC ..... *A24F 47/008* (2013.01); *A24B 15/28* (2013.01); *A24D 3/061* (2013.01); *A24F 47/006* (2013.01); *F23C 3/002* (2013.01); *F23Q 7/16* (2013.01)

(58) Field of Classification Search
CPC ..... A24D 3/061; A24F 47/002; A24F 47/004–47/008; A24F 47/006
(Continued)

(56) References Cited

U.S. PATENT DOCUMENTS 3,389,705 A * 6/1968 Levavi ..... A24D 3/045 131/201
3,774,622 A * 11/1973 Steigerwald ..... A24C 1/00 131/193
(Continued)

FOREIGN PATENT DOCUMENTS

EP 0236992 A2 9/1987
EP 0588247 A2 3/1994
(Continued)

OTHER PUBLICATIONS

International Search Report, issued in PCT/JP2014/056200, dated Jun. 3, 2014.
(Continued)

*Primary Examiner* — Nyca T Nguyen
(74) *Attorney, Agent, or Firm* — Birch, Stewart, Kolasch & Birch, LLP

(57) ABSTRACT

A burning type heat source (50) includes: a single longitudinal hollow (51) extending along the first direction (D1); and a lateral hollow (52) extending along a second direction (D2) crossing the first direction (D1), the lateral hollow (52) communicating with the longitudinal hollow (51). The ignition end (50Ae) is provided at the ignition end (50Ae) side in the first direction relative to a burning position at an end of a second inhalation.

24 Claims, 7 Drawing Sheets

(51) Int. Cl.

| | |
|---|---|
| ***A24D 3/06*** | (2006.01) |
| ***F23C 3/00*** | (2006.01) |
| ***F23Q 7/16*** | (2006.01) |

(58) Field of Classification Search
USPC ..... 128/202.12
See application file for complete search history.

(56) References Cited

U.S. PATENT DOCUMENTS

| | | | | |
|---|---|---|---|---|
| 4,340,072 | A * | 7/1982 | Bolt | A24F 13/04 131/273 |
| 4,854,331 | A * | 8/1989 | Banerjee | A24B 15/165 128/202.21 |
| 4,924,883 | A * | 5/1990 | Perfetti | A24F 47/004 131/335 |
| 4,962,773 | A * | 10/1990 | White | A24B 3/182 131/291 |
| 5,020,548 | A | 6/1991 | Farrier et al. | |
| 5,042,510 | A * | 8/1991 | Curtiss | A24F 47/002 131/270 |
| 5,099,861 | A | 3/1992 | Clearman et al. | |
| 5,129,409 | A * | 7/1992 | White | A24B 15/165 131/360 |
| 5,183,062 | A | 2/1993 | Clearman et al. | |
| 5,247,947 | A | 9/1993 | Clearman et al. | |
| 5,396,911 | A | 3/1995 | Casey, III et al. | |
| 8,061,361 | B2 | 11/2011 | Maeder et al. | |
| 2004/0226568 | A1 | 11/2004 | Takeuchi et al. | |
| 2008/0017204 | A1* | 1/2008 | Braunshteyn | A24D 3/045 131/202 |
| 2009/0065011 | A1 | 3/2009 | Maeder et al. | |
| 2011/0041861 | A1 | 2/2011 | Sebastian et al. | |
| 2012/0067360 | A1* | 3/2012 | Conner | A24B 15/165 131/280 |
| 2012/0080042 | A1 | 4/2012 | Nishimura et al. | |
| 2015/0013703 | A1 | 1/2015 | Akiyama et al. | |

FOREIGN PATENT DOCUMENTS

| | | | |
|---|---|---|---|
| EP | 2018813 | A1 | 1/2009 |
| JP | 2010-535530 | A | 11/2010 |
| WO | WO 03/056948 | A1 | 7/2003 |
| WO | WO 03/056949 | A1 | 7/2003 |
| WO | WO 2010/146693 | A1 | 12/2010 |
| WO | WO 2012/014490 | A1 | 2/2012 |
| WO | 2012/164077 | A1 | 12/2012 |
| WO | WO 2013/146951 | A2 | 10/2013 |

OTHER PUBLICATIONS

European Patent Office, "Communication with European Search Report," issued in connection with European Patent Application No. 14764662.4, dated Feb. 22, 2017.
Office Action issued in corresponding Japanese Application No. 2015-505467 dated May 24, 2016 (with English translation).
European Search Report, issued in European Patent Application No. EP 17 19 6107, dated Feb. 16, 2018.
Extended European Search Report, dated Jan. 22, 2019, for European Application No. 18199308.0.

* cited by examiner

BURNING TYPE HEAT SOURCE AND FLAVOR INHALER

CROSS REFERENCE TO RELATED APPLICATIONS

This application is a Continuation of PCT International Application No. PCT/JP2014/056200 filed on Mar. 10, 2014, which claims priority under 35 U.S.C. § 119(a) to Patent Application Nos. 2013-048092; 2013-048093, and 2013-048094 filed in Japan on Mar. 11, 2013, all of which are hereby expressly incorporated by reference into the present application.

TECHNICAL FIELD

The present invention relates to a burning type heat source and a flavor inhaler which are extends along a direction from an ignition end toward a non-ignition end.

BACKGROUND ART

Conventionally, there is known a flavor inhaler including: a burning type heat source extending along a direction from an ignition end toward a non-ignition end (hereinafter, referred to as "longitudinal axis direction"); and a holder that holds the burning type heat source. There are various types of proposals for such a flavor inhaler.

For example, Patent Literature 1 describes a flavor inhaler which has a burning type heat source including: a lattice partition wall in cross section perpendicular to the longitudinal axis direction; and a plurality of hollows extending along the longitudinal axis direction.

The burning type heat source used for the flavor inhaler is desirably capable of supplying a sufficient and stable heat amount over a plurality of inhalations (hereinafter, referred to as "puffs") performed from ignition to extinction.

In the above-described Patent Literature 1, a combustibility during ignition is improved by increasing a circumferential length of a flow path through which air flows in cross section perpendicular to the longitudinal axis direction. However, variation in a heat amount supplied in puffs performed from ignition to extinction is large, and it is impossible to supply a stable heat amount in puffs performed particularly from the middle to the latter half.

As a result of extensive studies, the inventors found that when a burning type heat source having a tubular shape with only a single hollow extending along the longitudinal axis direction being formed therein is used, for example, so as to reduce a contact area between inflow air flown during puffing and a burning area, it is possible to restrain a variation amount between an amount of heat to be generated during non-puffing (during natural burning) and an amount of heat to be generated during puffing to supply a stable heat amount in a puff performed from the middle to the latter half.

However, as a result of further studies, the inventors found that the above-described configuration of the burning type heat source is not capable of supplying a sufficient heat amount in a few puffs after ignition.

Thus, it is very difficult to achieve both of supplying a stable heat amount in a puff performed from the middle to the latter half and supplying a sufficient heat amount in a few puffs after ignition.

CITATION LIST

Patent Literature

[Patent Literature 1] International Publication WO2010/146693

SUMMARY

A burning type heat source according to a first feature extends along a first direction from an ignition end toward a non-ignition end. The burning type heat source including: a single longitudinal hollow extending along the first direction; and a lateral hollow extending along a second direction crossing the first direction, the lateral hollow communicating with the longitudinal hollow. The lateral hollow is provided at the ignition end side in the first direction relative to a burning position at an end of a second inhalation.

In the first feature, a distance from the ignition end to the lateral hollow in the first direction is less than 4 mm.

In the first feature, a distance from the ignition end to the lateral hollow in the first direction is 1 mm or less.

In the first feature, an area of the longitudinal hollow in cross section perpendicular to the first direction is 1.77 $mm^2$ or more.

In the first feature, an amount of inflow air flown from the longitudinal hollow at the ignition end is 40% or less of an amount of outflow air flown from the longitudinal hollow at the non-ignition end.

In the first feature, the burning type heat source has a cylindrical shape extending along the first direction. An outer diameter of the burning type heat source is 3 mm or more and 15 mm or less.

In the first feature, a length of the burning type heat source in the first direction is 5 mm or more and 30 mm or less.

A flavor inhaler according to a second feature includes: a burning type heat source extending along a first direction from an ignition end toward a non-ignition end; and a holder holding the burning type heat source. The burning type heat source comprises: a single longitudinal hollow extending along the first direction; and a lateral hollow extending along a second direction crossing the first direction, the lateral hollow communicating with the longitudinal hollow. The lateral hollow is provided at the ignition end side in the first direction relative to a burning position at an end of a second inhalation.

A flavor inhaler according to a third feature includes: a burning type heat source extending along a first direction from an ignition end toward a non-ignition end; and a holder holding the burning type heat source. The burning type heat source comprises: a longitudinal hollow extending along the first direction; and a lateral hollow extending along a second direction crossing the first direction, the lateral hollow communicating with the longitudinal hollow. The lateral hollow is configured to be visible from outside of the holder in the second direction.

In the third feature, the ignition end of the burning type heat source protrudes from the holder. The lateral hollow is exposed from the holder.

In the third feature, a distance from the ignition end to the lateral hollow in the first direction is 5 mm or less.

In the third feature, a burning stop position is provided in the burning type heat source at the non-ignition end side relative to the lateral hollow in the first direction. A distance from the lateral hollow to the burning stop position in the first direction is 5 mm or less.

In the third feature, an area of the longitudinal hollow in cross section perpendicular to the first direction is larger than an area of the lateral hollow in cross section perpendicular to the second direction.

In the third feature, an area of the longitudinal hollow in cross section perpendicular to the first direction is 1.77 $mm^2$ or more.

In the third feature, the burning type heat source has a cylindrical shape extending along the first direction. An outer diameter of the burning type heat source is 3 mm or more and 15 mm or less.

In the third feature, a length of the burning type heat source in the first direction is 5 mm or more and 30 mm or less.

A flavor inhaler according to a fourth feature includes: a burning type heat source extending along a first direction from an ignition end toward a non-ignition end; and a holder holding the burning type heat source. The burning type heat source has a tubular shape including an outer wall that forms a single longitudinal hollow extending along the first direction. An area of the longitudinal hollow in cross section perpendicular to the first direction is 1.77 $mm^2$ or more. An amount of inflow air flown from the longitudinal hollow at the ignition end is 75% or less of an amount of outflow air flown from a mouthpiece of the flavor inhaler.

In the fourth feature, the amount of inflow air flown from the longitudinal hollow at the ignition end is 40% or less of the amount of outflow air flown from the mouthpiece of the flavor inhaler.

In the fourth feature, the burning type heat source comprises a lateral hollow extending along a second direction crossing the first direction, the lateral hollow communicating with the longitudinal hollow.

In the fourth feature, the holder has a holder-side hollow opening toward a second direction crossing the first direction.

In the fourth feature, the holder houses a flavor source. The holder-side hollow is provided at an outer part of the flavor source or at the ignition end side relative to the outer part of the flavor source in the second direction.

In the fourth feature, the holder houses a capsule filter. The holder-side hollow is provided at an outer part of the capsule filter or at the ignition end side relative to the outer part of the capsule filter in the second direction.

In the fourth feature, the burning type heat source has a cylindrical shape extending along the first direction. An outer diameter of the burning type heat source is 3 mm or more and 15 mm or less.

In the fourth feature, a length of the burning type heat source in the first direction is 5 mm or more and 30 mm or less.

DESCRIPTION OF EMBODIMENTS

Figure 1:
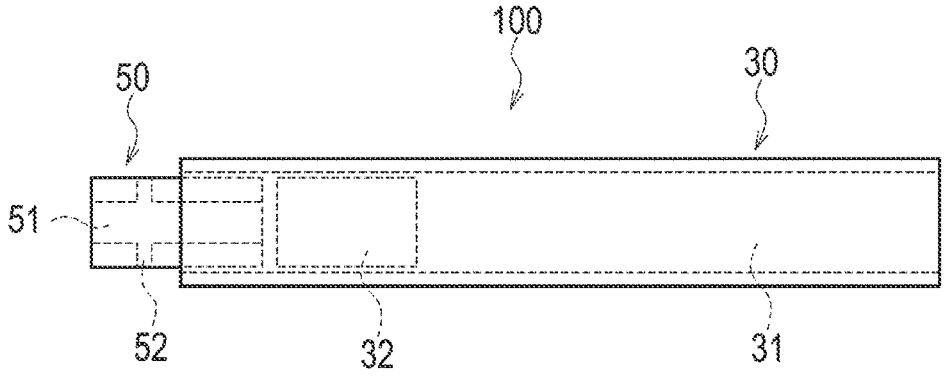
FIG. 1 is a drawing showing a flavor inhaler 100 according to a first embodiment.

Hereinafter, the embodiments of the present invention will be described with reference to the drawings. In the following drawings, identical or similar components are denoted by identical or similar reference numerals.

Therefore, specific dimensions should be determined with reference to the description below. It is needless to mention that different relationships and ratio of dimensions may be included in different drawings.

Summary of Embodiment

A burning type heat source according to an embodiment extends along a first direction from an ignition end toward a non-ignition end. The burning type heat source includes: a single longitudinal hollow extending along the first direction; and a lateral hollow extending along a second direction crossing the first direction, the lateral hollow communicating with the longitudinal hollow. The lateral hollow is provided at the ignition end side in the first direction relative to a burning position at an end of a second inhalation.

In the embodiment, the burning type heat source has the single longitudinal hollow extending along the first direction. This reduces a contact area between inflow air flown during puffing and a burning area, and thus, it is possible to restrain a variation amount between an amount of heat to be generated during non-puffing (during natural burning) and an amount of heat to be generated during puffing, and it is possible to supply a stable heat amount in a puff performed from the middle to the latter half.

In the embodiment, the burning type heat source has a lateral hollow communicating with the longitudinal hollow, and the lateral hollow is provided at the ignition end side relative to the burning position at an end of a second inhalation. As a result, an initial burning is promoted by air supplied from the lateral hollow, and it is possible to increase a heat amount supplied at least in a second puff.

Thus, it is possible to achieve both of supplying a stable heat amount in a puff performed from the middle to the latter half and increasing a heat amount supplied in a few puffs after ignition.

First Embodiment

Flavor Inhaler

Figure 2:
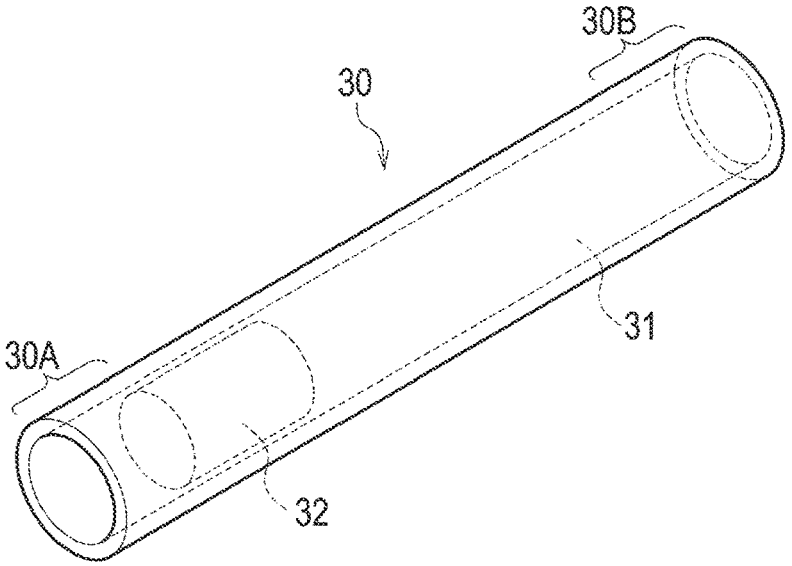
FIG. 2 is a drawing showing a holder 30 according to the first embodiment.
Figure 3:
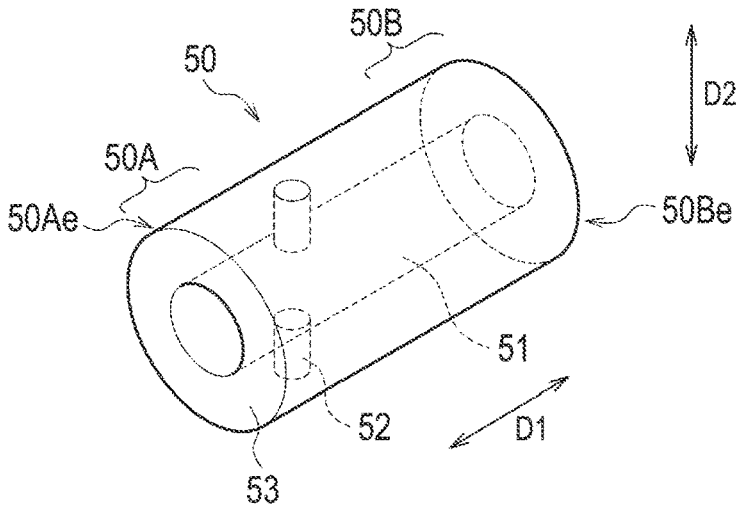
FIG. 3 is a drawing showing a burning type heat source 50 according to the first embodiment.

A flavor inhaler according to a first embodiment will be described, below. FIG. 1 is a drawing showing a flavor inhaler 100 according to the first embodiment. FIG. 2 is a drawing showing a holder 30. FIG. 3 is a drawing showing a burning type heat source 50.

As shown in FIG. 1, the flavor inhaler 100 has the holder 30 and the burning type heat source 50. In the first embodiment, it should be noted that the flavor inhaler 100 is a flavor inhaler without burning a flavor source.

As shown in FIG. 2, the holder 30 holds the burning type heat source 50. The holder 30 has a supporting end portion 30A and a mouthpiece side end portion 30B. The supporting end portion 30A is an end portion that holds the burning type heat source 50. The mouthpiece side end portion 30B is an end portion provided at a mouthpiece side of the flavor inhaler. In the first embodiment, the mouthpiece side end portion 30B configures a mouthpiece of the flavor inhaler 100. However, the mouthpiece of the flavor inhaler 100 may be provided separately of the holder 30.

The holder 30 has a tubular shape having a hollow 31 extending along a direction from the supporting end portion 30A toward the mouthpiece side end portion 30B. For example, the holder 30 has a cylindrical shape or a rectangular tubular shape.

In the first embodiment, the holder 30 houses a flavor source 32. The flavor source 32 releases a flavor by transmitted a heat generated from the burning type heat source 50, for example. As the flavor source 32, for example, it is possible to use a tobacco leaf and adopt general shredded tobacco used in a cigarette (paper-wrapped tobacco), granular tobacco used in a snuff, and a tobacco raw material of a roll tobacco, a tobacco compact, etc. Further, a support made of a porous material or a non-porous material may be adopted as the flavor source 32.

The roll tobacco is obtained by forming a sheet-like regenerated tobacco into a roll, and has a flow path therein. Further, the tobacco compact is obtained by mold-forming the granular tobacco. Moreover, the tobacco raw material or the support used as the above-described flavor source 32 may include a desired flavor.

In the first embodiment, a case in which the holder 30 has a tubular shape is shown as an example. However, the embodiment is not limited thereto. That is, the holder 30 may suffice to have a configuration for holding the burning type heat source 50.

As shown in FIG. 3, the burning type heat source 50 has an ignition end portion 50A and a non-ignition end portion 50B. The ignition end portion 50A is an end portion that is exposed from the holder 30 in a state where the burning type heat source 50 is inserted into the holder 30. The non-ignition end portion 50B is an end portion that is inserted into the holder 30.

Specifically, the burning type heat source 50 has a shape extending along a first direction D1 from the ignition end 50Ae toward the non-ignition end 50Be. The burning type heat source 50 has a longitudinal hollow 51, a lateral hollow 52 and an outer wall 53.

The longitudinal hollow 51 is partitioned by the outer wall 53 and has a shape extending along the first direction D1. An area of the longitudinal hollow 51 in cross section perpendicular to the first direction D1 is larger than an area of the lateral hollow 52 in cross section perpendicular to a second direction D2. For example, the area of the longitudinal hollow 51 in cross section perpendicular to the first direction D1 is preferably 1.77 $mm^2$ or more.

In the first embodiment, it should be noted that the number of longitudinal hollows 51 formed in the burning type heat source 50 is singular.

The lateral hollow 52 extends along the second direction D2 crossing the first direction D1 and communicates with the longitudinal hollows 51. Further, the second direction D2 has only to cross the first direction D1, and may not be perpendicular to the first direction D1.

Here, in the first direction D1, the lateral hollow 52 is provided at the ignition end 50Ae side relative to the burning position at an end of a second inhalation. That is, a distance (L1 shown in FIG. 4) from the ignition end 50Ae to the lateral hollow 52 is shorter than a distance from the ignition end 50Ae to the burning position at the end of the second inhalation. For example, the distance from the ignition end 50Ae to the lateral hollow 52 in the first direction D1 is preferably less than 4 mm. In addition, the distance from the ignition end 50Ae to the lateral hollow 52 in the first direction D1 is preferably 1 mm or less.

Figure 4:
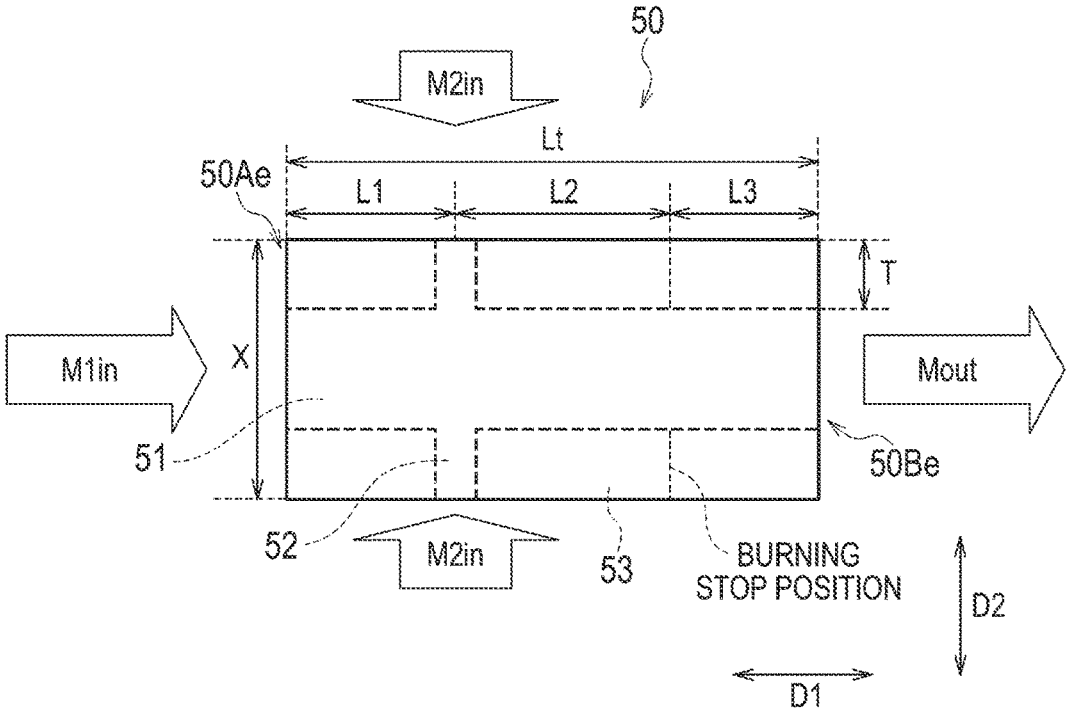
FIG. 4 is a drawing for explaining an air flow amount according to the first embodiment.

Further, in the first direction D1, L2 shown in FIG. 4 denotes a distance from the lateral hollow 52 to a boundary position between the burning type heat source 50 and the holder 30, that is, in a state where the burning type heat source 50 is inserted into the holder 30, to a boundary position between a part of the burning type heat source 50 exposed from the holder 30 and a part of the burning type heat source 50 not exposed from the holder 30. Therefore, a distance (L3 shown in FIG. 4) from the boundary position to the non-ignition end 50Be in the first direction D1 is an amount by which the burning type heat source 50 is inserted into the holder 30.

In the first embodiment, the number of lateral hollows 52 formed in the burning type heat source 50 is not limitative in particular, and may be singular or plural. Here, in a case where the burning type heat source 50 is provided with a plurality of lateral hollows 52, at least, the lateral hollow 52 provided at a position closest to the ignition end 50Ae is provided at the ignition end 50Ae side relative to the burning position at an end of a second inhalation.

In a state where the holder 30 holds the burning type heat source 50, the lateral hollow 52 is preferably configured to be visible from outside of the holder 30 in the second direction D2. For example, in a state where the holder 30 holds the burning type heat source 50, the ignition end 50Ae of the burning type heat source 50 protrudes from the holder 30 and the lateral hollow 52 is exposed from the holder 30.

The outer wall 53 has a tubular shape defining the longitudinal hollow 51. A thickness (T shown in FIG. 4) of the outer wall 53 may be 0.5 mm or more and 7.0 mm or less, and preferably, be 0.75 mm or more and 3.0 mm or less.

In the first embodiment, a size (Lt shown in FIG. 4) of the burning type heat source 50 in the first direction D1 is preferably 5 mm or more and 30 mm or less. Further, a size (X shown in FIG. 4) of the burning type heat source 50 in the second direction D2 is preferably 3 mm or more and 15 mm or less.

Here, when the burning type heat source 50 has a cylindrical shape, the size of the burning type heat source 50 in the second direction D2 is an outer diameter of the burning type heat source 50. When the burning type heat source 50 does not have a cylindrical shape, the size of the burning type heat source 50 in the second direction D2 is a maximum value of the burning type heat source 50 in the second direction D2.

The burning type heat source 50 is configured by a mixture including a flammable substance. For example, as the burning type heat source 50, it is possible to use, for example, a carbon heat source which may be obtained by integrally molding a mixture including a carbonaceous material, a nonflammable additive, a binder (organic binder or inorganic binder), and water by a method such as extrusion molding, tablet molding, and pressure slip casting, or a tobacco compact in which a powdery and granular body of tobacco leaf substitutes for a part or all of a carbonaceous material.

The burning type heat source 50 preferably comprises a carbonaceous material in a range of 10 wt % to 99 wt % when a weight of the burning type heat source 50 is 100 wt %. As the carbonaceous material, that which is plant-derived and obtained by removing a volatile impurity through a heat treatment, etc., is preferably used. In view of a burning characteristic such as supplying of a sufficient heat amount and tightening of ash, the burning type heat source 50 preferably comprises a carbonaceous material in a range of 30 wt % to 70 wt %, and more preferably comprises a carbonaceous material in a range of 40 wt % to 50 wt %.

Examples of the organic binder may include a mixture including at least one of CMC (carboxymethyl cellulose), CMC-Na (carboxymethyl-cellulose sodium), alginate, EVA, PVA, PVAC, and saccharides.

Examples of the inorganic binder may include a mineral-based binder such as purified bentonite or a silica-based binder such as colloidal silica, water glass, and calcium silicate.

For example, in view of a flavor, when the weight of the burning type heat source 50 is 100 wt %, the binder preferably comprises 1 wt % to 10 wt % of CMC, and preferably comprises 1 wt % to 8 wt % of CMC.

Examples of the nonflammable additive may use a carbonate or an oxide including sodium, potassium, calcium, magnesium, and silicon, etc. The burning type heat source 50 may comprise 10 wt % to 89 wt % of the nonflammable additive when the weight of the burning type heat source 50 is 100 wt %. Further, when calcium carbonate is used as the nonflammable additive, the burning type heat source 50 preferably comprises 40 wt % to 55 wt % of the nonflammable additive, and the tobacco compact preferably comprises 10 wt % to 30 wt % of the nonflammable additive.

In order to improve a burning characteristic, the burning type heat source 50 may comprise 5 wt % or less, preferably 1 wt % or less, of alkali metal salts such as sodium chloride when the weight of the burning type heat source 50 is 100 wt %.

(Air Flow Amount)

An air flow amount according to the first embodiment will be described, below. FIG. 4 is a drawing for explaining the air flow amount according to the first embodiment.

As shown in FIG. 4, at the time of ignition of the burning type heat source 50, an amount of air flown into the longitudinal hollow 51 at the ignition end 50Ae is expressed by "M1in". At the time of ignition of the burning type heat source 50, an amount of outflow air flown from the longitudinal hollow 51 at the non-ignition end 50Be is expressed by "Mout". An amount of air flown into the longitudinal hollow 51 from each lateral hollow 52 at the time of ignition of the burning type heat source 50 is expressed by "M2in". Accordingly, a relationship of $Mout=M1in+\Sigma M2in$ is satisfied.

In such a case, the amount of air (M1in) flown into the longitudinal hollow 51 at the ignition end 50Ae is preferably 75% or less of the amount of flowout air (Mout) flown from the longitudinal hollow 51 at the non-ignition end 50Be. Further, the amount of air (M1in) flown into the longitudinal hollow 51 at the ignition end 50Ae is preferably 40% or less of the amount of flowout air (Mout) flown from the longitudinal hollow 51 at the non-ignition end 50Be.

In the first embodiment, the number of lateral hollows 52 formed in the burning type heat source 50 and the area of the lateral hollow 52 in cross section perpendicular to the second direction D2 are configured to satisfy such a condition.

In the first embodiment, the holder 30 does not have a hollow opening toward the second direction D2 crossing the first direction D1. Therefore, when the amount of air (M1in) flown into the longitudinal hollow 51 at the ignition end 50Ae is 75% or less of the amount of outflow air (Mout) flown from the longitudinal hollow 51 at the non-ignition end 50Be, the amount of air (M1in) is 75% or less of an amount of outflow air flown from the mouthpiece of the flavor inhaler 100.

(Operation and Effect)

In the first embodiment, the burning type heat source 50 has a single longitudinal hollow 51 extending along the first direction. Therefore, by reducing a contact area between inflow air flown during puffing and a burning area, it is possible to restrain a variation amount between an amount of heat to be generated during non-puffing (during natural burning) and an amount of heat to be generated during puffing and it is possible to supply a stable heat amount in a puff performed from the middle to the latter half.

In the first embodiment, the burning type heat source 50 has the lateral hollow 52 communicating with the longitudinal hollow 51. The lateral hollow 52 is provided at the ignition end 50Ae side in the first direction D1 relative to the burning position at an end of a second inhalation. As a result, an initial burning is promoted by air supplied from the lateral hollow 52, and it is possible to increase a heat amount supplied in at least second puff.

Thus, it is possible to achieve both of supplying a stable heat amount in a puff performed from the middle to the latter half and increasing a heat amount supplied in a few puffs after ignition.

As described above, the distance from the ignition end 50Ae to the lateral hollow 52 in the first direction D1 is preferably less than 4 mm. As a result, an initial burning is promoted by air supplied from the lateral hollow 52, and it is possible to supply a sufficient heat amount in a few puffs after ignition. In addition, the distance from the ignition end 50Ae to the lateral hollow 52 in the first direction D1 is preferably 1 mm or less. As a result, it is possible to supply a more stable heat amount in a few puffs after ignition.

In the first embodiment, the area of the longitudinal hollow 51 in cross section perpendicular to the first direction D1 is larger than the area of the lateral hollow 52 in cross section perpendicular to the second direction D2.

In the first embodiment, the area of the longitudinal hollow 51 in cross section perpendicular to the first direction D1 is preferably 1.77 $mm^2$ or more. As a result, pressure loss that occurs at the time of inhalation is reduced, and it enables a user to smoothly suck a flavor inhaler.

In the first embodiment, the amount of air (M1in) flown into the longitudinal hollow 51 at the ignition end 50Ae is preferably 75% or less of the amount of outflow air (Mout) flown from the longitudinal hollow 51 at the non-ignition end 50Be. Further, the amount of air (M1in) flown into the longitudinal hollow 51 at the ignition end 50Ae is preferably 40% or less of the amount of outflow air (Mout) flown from the longitudinal hollow 51 at the non-ignition end 50Be. This restrains a flame of a gas lighter from flowing into the longitudinal hollow 51.

Thus, it is possible to achieve both of supplying a stable heat amount in a puff performed from the middle to the latter half and restraining a flame of a gas lighter from flowing into during ignition.

In a first feature, the burning type heat source 50 has a cylindrical shape extending along the first direction D1, and the outer diameter of the burning type heat source 50 is 3 mm or more and 15 mm or less. Further, a length of the burning type heat source 50 in the first direction D1 is 5 mm or more and 30 mm or less. As a result, it is possible to supply a sufficient heat amount over a sufficient time to the flavor source 32 housed in the holder 30 while appropriately suppressing an increase in the size of the burning type heat source 50.

In the first embodiment, the lateral hollow 52 communicating with the longitudinal hollow 51 is configured to be visible from outside of the holder 30 in the second direction D2. Therefore, since the lateral hollow 52 which is visible from outside of the holder 30 turns red by a burning of the burning type heat source 50, a visibility of burning state of the burning type heat source 50 is improved, and thus, a user is capable of visually confirming the burning state of the burning type heat source 50 even while holding the flavor inhaler 100 in the mouth.

[First Modification]

A first modification of the first embodiment will be described, below. Description proceeds with a particular focus on a difference from the first embodiment, below.

Specifically, in the first embodiment, the holder 30 does not have a hollow opening toward the second direction D2 crossing the first direction D1. Therefore, when the amount of air (M1in) flown into the longitudinal hollow 51 at the ignition end 50Ae is 75% or less of the amount of outflow air (Mout) flown from the longitudinal hollow 51 at the non-ignition end 50Be, the amount of air (M1in) is 75% or less of an amount of outflow air flown from the mouthpiece of the flavor inhaler 100.

Figure 5:
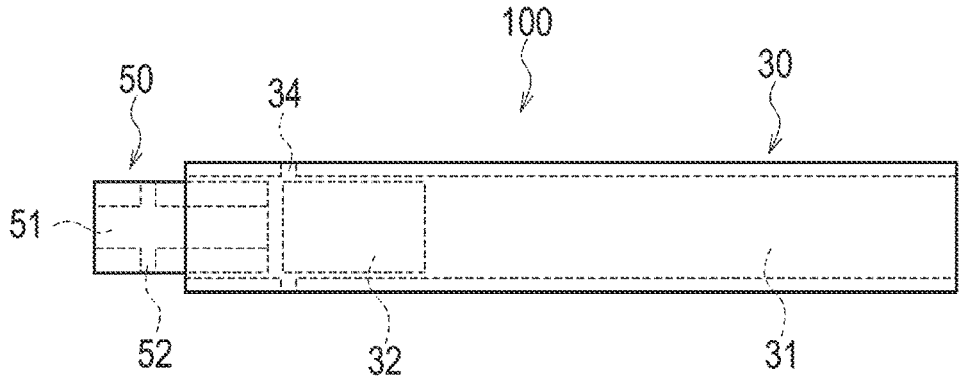
FIG. 5 is a drawing showing a flavor inhaler 100 according to a first modification.
Figure 6:
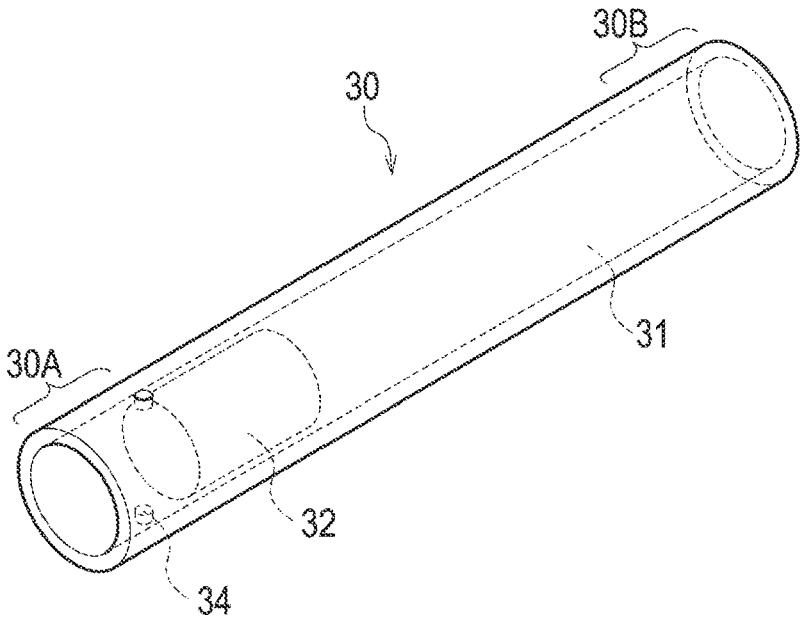
FIG. 6 is a drawing showing a holder 30 according to the first modification.

In contrast, in the first modification, as shown in FIG. 5 and FIG. 6, the holder 30 has a holder-side hollow 34 which communicates with the hollow 31 and which opens toward the second direction D2 crossing the first direction D1. Further, the second direction D2 has only to cross the first direction D1, and may not be perpendicular to the first direction D1.

In the second direction D2, the holder-side hollow 34 is preferably provided at an outer part of the flavor source 32 or at the ignition end 50Ae side relative to the outer part of the flavor source 32.

(Air Flow Amount)

Figure 7:
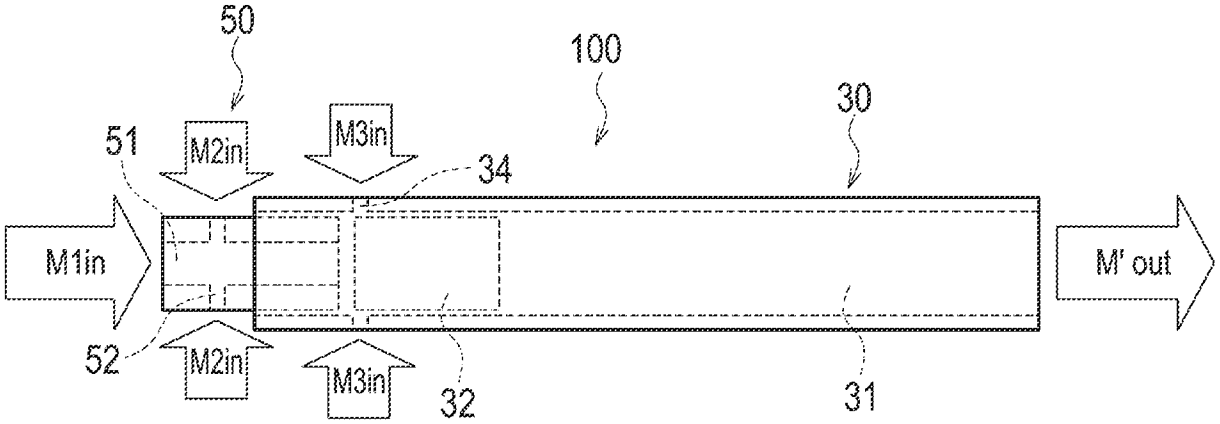
FIG. 7 is a drawing for explaining an air flow amount according to the first modification.

An air flow amount according to the first modification will be described, below. FIG. 7 is a drawing for explaining the air flow amount according to the first modification.

As shown in FIG. 7, at the time of ignition of the burning type heat source 50, an amount of air flown into the longitudinal hollow 51 at the ignition end 50Ae is expressed by "M1in". An amount of outflow air flown from the mouthpiece of the flavor inhaler 100 at the time of ignition of the burning type heat source 50 is expressed by "M'out". An amount of air flown into the longitudinal hollow 51 from each lateral hollow 52 at the time of ignition of the burning type heat source 50 is expressed by "M2in". An amount of air flown into the hollow 31 from each holder-side hollow 34 at the time of ignition of the burning type heat source 50 is expressed by "M3in". Accordingly, a relationship of $M'out=M1in+\Sigma M2in+\Sigma M3in$ is satisfied.

In such a case, the amount of air (M1in) flown into the longitudinal hollow 51 at the ignition end 50Ae is 75% or less of the amount of outflow air (M'out) flown from the mouthpiece of the flavor inhaler 100. Further, the amount of air (M1in) flown into the longitudinal hollow 51 at the ignition end 50Ae is preferably 40% or less of the amount of outflow air (M'out) flown from the mouthpiece of the flavor inhaler 100.

In the first modification, the number of lateral hollows 52 formed in the burning type heat source 50, the area of the lateral hollow 52 in cross section perpendicular to the second direction D2, the number of holder-side hollows 34 formed in the holder 30, and an area of the holder-side hollow 34 in cross section perpendicular to the second direction D2 are configured to satisfy such a condition.

(Operation and Effect)

In the first modification, the amount of air (M1in) flown into the longitudinal hollow 51 at the ignition end 50Ae is 75% or less of the amount of outflow air (M'out) flown from the mouthpiece of the flavor inhaler 100. Further, the amount of air (M1in) flown into the longitudinal hollow 51 at the ignition end 50Ae is preferably 40% or less of the amount of outflow air (M'out) flown from the mouthpiece of the flavor inhaler 100. This restrains a flame of a gas lighter from flowing into the longitudinal hollow 51.

In the first modification, the holder-side hollow 34 is preferably provided at the outer part of the flavor source 32 or at the ignition end 50Ae side relative to the outer part of the flavor source 32 in the second direction D2. This restrains a decrease in the quantity of airflow to the flavor source 32 and restrains a flavor ingredient volatilized from the flavor source 32 from being diluted by air flown into the hollow 31 from the holder-side hollow 34.

[Second Modification]

A second modification of the first embodiment is described, below. Description proceeds with a particular focus on a difference from the first embodiment, below.

As described above, in the first embodiment, the lateral hollow 52 is provided at the ignition end 50Ae side relative to the burning position at an end of a second inhalation in the first direction D1.

In contrast, in the second modification, the distance (L1 shown in FIG. 4) from the ignition end 50Ae to the lateral hollow 52 in the first direction D1 is preferably 5 mm or less. As a result, since the lateral hollow 52 which is provided to be visible from outside of the holder 30 turns red by a burning of the burning type heat source 50, a user is capable of visually confirming the burning state of the burning type heat source 50 even in a puff performed in the former half while holding the flavor inhaler 100 in the mouth, so that it is possible for the user to confirm without stress whether the burning type heat source 50 is ignited uniformly and sufficiently after ignition by a lighter, etc. The distance (L2 shown in FIG. 4) from the lateral hollow 52 to a burning stop position in the first direction D1 is preferably 5 mm or less. As a result, the user is capable of visually confirming the burning state of the burning type heat source 50 even in a puff performed in the later half while holding the flavor inhaler 100 in the mouth, and is capable of easily confirming that the burning type heat source 50 reaches a position to stop burning.

In the second modification, the lateral hollow 52 may be provided at both a position at a distance of 5 mm or less from the ignition end 50Ae and a position at a distance of 5 mm or less to the burning stop position. Alternatively, the lateral hollow 52 may be provided at either one of the position at a distance of 5 mm or less from the ignition end 50Ae and the position at a distance of 5 mm or less to the burning stop position.

The burning stop position is a position where the burning type heat source 50 should stop burning before a burning of the outer circumference surface of the burning type heat source 50 reaches a predetermined position. The predetermined position is a boundary position between a part exposed from the holder 30 and a part not exposed from the holder 30 in a state where the holder 30 holds the burning type heat source 50. The burning stop position, for example, is provided within a range of 1 mm or more and 5 mm or less from the boundary position. Preferably, the burning stop position is provided within a range of 3 mm or more and 5 mm or less. Therefore, the distance (L3 shown in FIG. 4) from the burning stop position to the non-ignition end 50Be in the first direction D1 is an amount by which the burning type heat source 50 is inserted into the holder 30.

In the second modification, the number of lateral hollows 52 formed in the burning type heat source 50 is not limitative in particular, and may be singular or plural. Here, in a case where a plurality of lateral hollows 52 are provided, at least lateral hollow 52 provided at a position closest to the ignition end 50Ae is provided within a range of 5 mm or less from the ignition end 50Ae or a lateral hollow 52 provided at a position closest to the burning stop position is provided within a range of 5 mm or less from the burning stop position.

It should be noted that the position where the lateral hollow 52 is provided in the second modification can be made compatible with the position where the lateral hollow 52 is provided in the first embodiment.

In the second modification, the number of longitudinal hollows 51 formed in the burning type heat source 50 need not be singular. That is, the number of longitudinal hollows 51 formed in the burning type heat source 50 may be plural. Moreover, in such a case, the lateral hollow 52 may communicate with at least one of a plurality of the longitudinal hollows 51.

In the second modification, it should be noted that the lateral hollow 52 is configured to be visible from outside of the holder 30 in the second direction D2.

[Third Modification]

A third modification of the first embodiment will be described, below. Description proceeds with a particular focus on a difference from the first embodiment, below.

Figure 8:
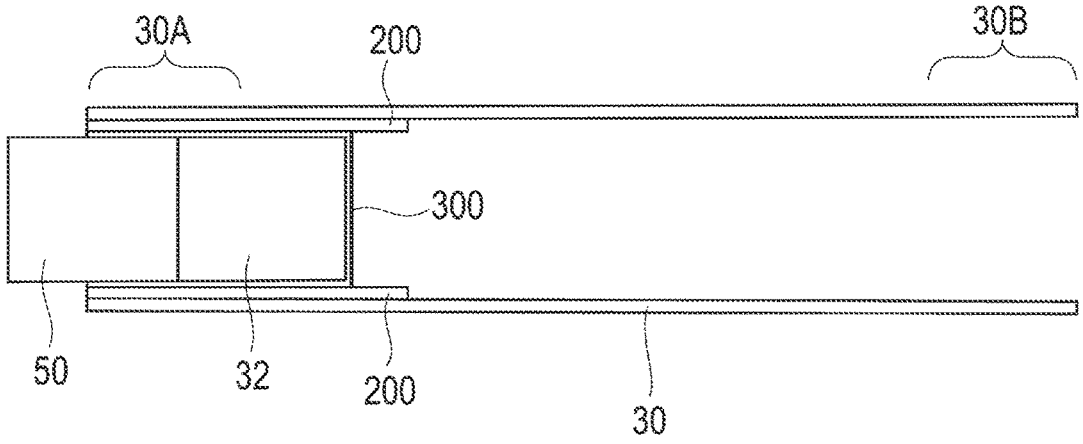
FIG. 8 is a drawing showing a flavor inhaler according to a third modification.
Figure 9:
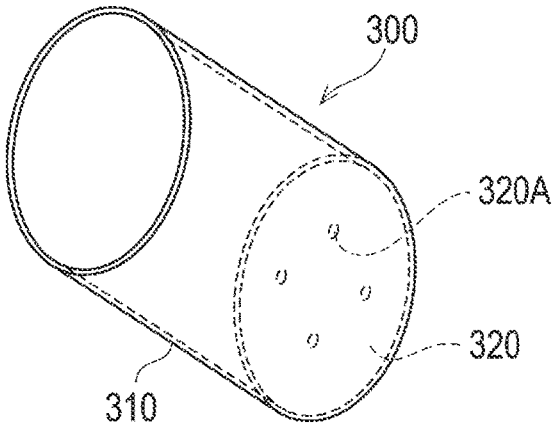
FIG. 9 is a drawing showing a cup member 300 according to the third modification.

Although not particularly mentioned in the first embodiment, in the third modification, as shown in FIG. 8 and FIG. 9, the flavor inhaler includes a heat conduction member 200 and a cup member 300, in addition to the holder 30 and the burning type heat source 50.

The heat conduction member 200 is provided on an inner surface of the holder 30 in the supporting end portion 30A of the holder 30. The heat conduction member 200 is preferably formed of a metal material having an excellent heat conductivity, and is configured of aluminum, for example. A length of the heat conduction member 200 in the predetermined direction is preferably at least longer than a length of the cup member 300. That is, the heat conduction member 200 projects toward the mouthpiece side end portion 30B side relative to the cup member 300. The length of the heat conduction member 200 may be the same as the length of the holder 30.

The cup member 300 has a cup shape, houses the flavor source 32 (here, a flavor source), and holds the burning type heat source 50. The cup member 300 is configured to be inserted into the supporting end portion 30A of the holder 30. In particular, the cup member 300 is configured by a tubular side wall 310 and by a bottom plate 320 covering one opening configured by the side wall 310. The flavor source 32 (here, a flavor source) and the burning type heat source 50 are inserted into the cup member 300 from one opening configured by the side wall 310. The bottom plate 320 has a plurality of air holes 320A through which air passes.

Here, the flavor source 32 (here, a flavor source) is configured by powdery and granular tobacco leaf, for example. In such a case, a size of the air hole 320A is smaller than a particle diameter of the tobacco leaf.

In the third modification, a thickness of the side wall 310 is preferably 0.1 mm or less. As a result, a heat capacity of the side wall 310 is reduced, and a heat generated from the burning type heat source 50 is efficiently transmitted to the flavor source. Further, the side wall 310 is preferably configured by SUS (for example, SUS430). As a result, even when the thickness of the side wall 310 is 0.1 mm or less, it is possible to obtain a sufficient strength as the strength of the side wall 310 so that the shape of the cup member 300 can be maintained. The bottom plate 320 is preferably configured by the same member (for example, SUS430) as the side wall 310.

Experiment Result

An experiment result will be described, below. In an experiment described below, a mixture including 100 g of activated carbon, 90 g of calcium carbonate, 10 g of CMC-Na, and 270 g of water including 1 g of sodium chloride were kneaded, and a molding that was molded by extrusion-molding the kneaded mixture was dried. Then, by cutting the dried molding, a burning type heat source which has a longitudinal hollow with a length of 17 mm in the first direction, an outer diameter of 6.2 mm, and a diameter of 2.5 mm was obtained. Then, a sample used for the experiment was created by inserting such a burning type heat source approximately 5 mm into a substantially air impermeable paper tube holder with an inner diameter which was almost the same as an outer diameter of the burning type heat source.

Experiment Result 1

In an experiment result 1, a sample not having a lateral hollow was prepared as Comparative Example 1, and a sample having a lateral hollow at a distance of 4 mm from an ignition end was prepared as Comparative Example 2. Further, as Examples 1 to 6, a sample having a lateral hollow at a distance of 1 mm, 1.5 mm, 2 mm, 2.5 mm, 3.0 mm, and 3.5 mm from an ignition end was respectively prepared. By using these samples, a maximum temperature of gas flown into the paper tube holder from the burning type heat source in a second puff was measured. The samples according to the Examples 1 to 6 have four lateral hollows with a diameter of 2 mm. Further, in the present experiment, ignition was performed by keeping a heat generating portion of an electrothermal lighter at a position apart approximately 1 mm from the ignition end of the burning type heat source to perform preheating for 8 seconds, and then inhaling (puffing) for 2 seconds with a suction capacity of 55 mL. In a subsequent puff, the same inhaling operation as those described above was repeated at every 30 seconds, except for ignition operation using a lighter.

Figure 10:
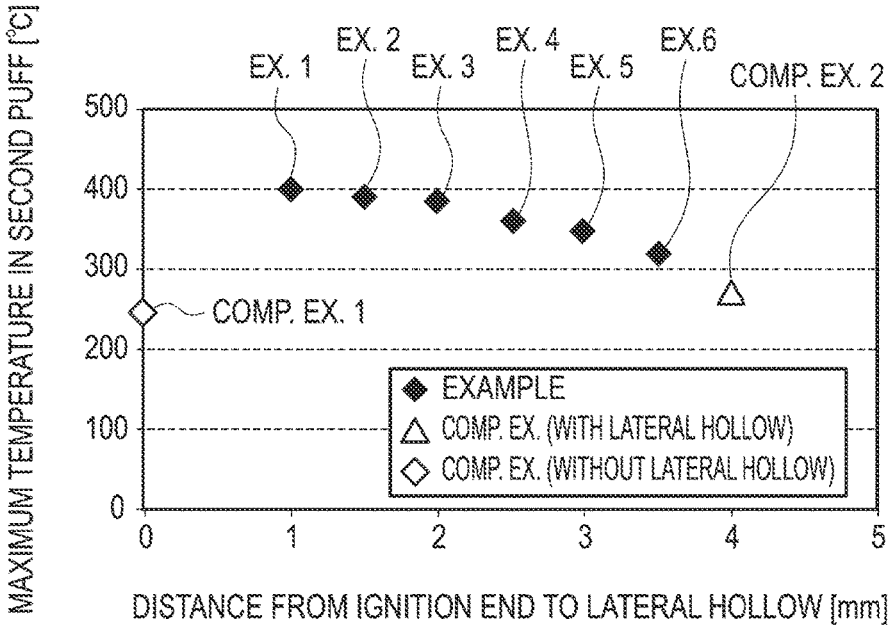
FIG. 10 is a drawing showing an experiment result 1.

FIG. 10 is a graph showing the experiment result 1. As shown in FIG. 10, it was confirmed that the maximum temperature in a second puff in the Examples 1 to 6 was high, as compared with the Comparative Example 1 and 2. That is, it was confirmed that when a distance from the ignition end to the lateral hollow was less than 4 mm, it was possible to increase a heat amount supplied since the burning position of the burning type heat source reaches the lateral hollow in at least second puff and a burning amount increases.

In view of improving the visibility of burning state of the burning type heat source, the distance from the ignition end to the lateral hollow in the first direction D1 may be 5 mm or less. It should be noted that the lateral hollow turns red even when the distance from the ignition end to the lateral hollow is 4 mm or more and 5 mm or less.

Experiment Result 2

In an experiment result 2, the above-described samples of the Comparative Example 2 and Examples 1 to 3 were prepared. By using these samples, a maximum temperature of gas flown into the paper tube holder from the burning type heat source in the first to fourth puffs was measured. In the present experiment, ignition of the burning type heat source and inhaling operations were performed by using an electrothermal lighter, in the same way as in the experiment result 1.

Figure 11:
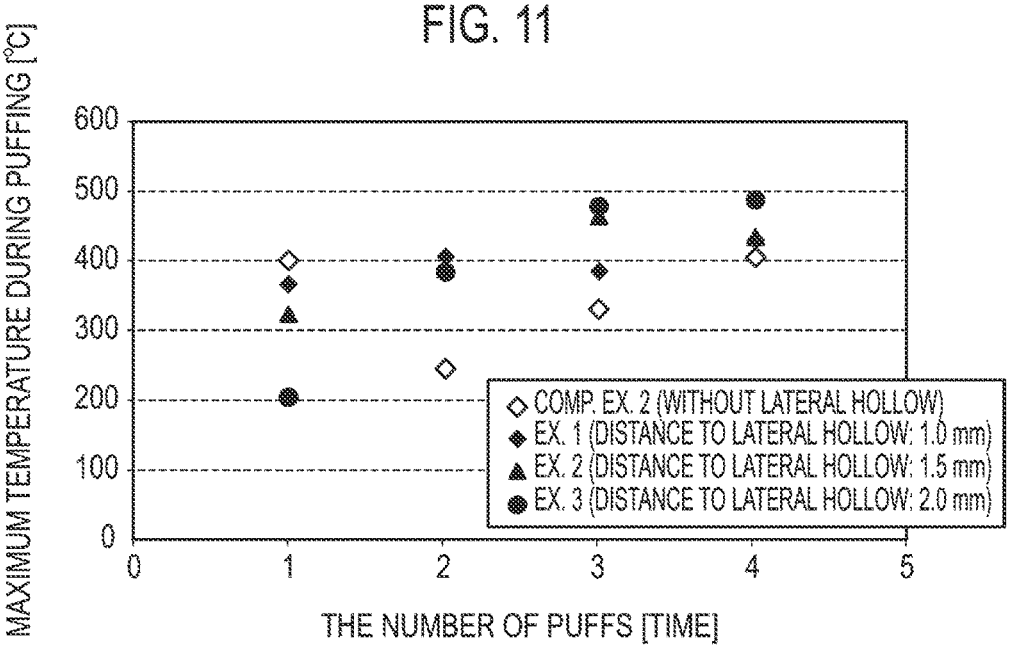
FIG. 11 is a drawing showing an experiment result 2.

FIG. 11 is a graph showing the experiment result 2. As shown in FIG. 11, it was confirmed that variation in the maximum temperature of gas flown into the paper tube holder from the burning type heat source in the first to fourth puffs (initial puffs) was small in the Example 1, as compared with the Comparative Example 2 and Examples 2 and 3. It was confirmed that when the distance from the ignition end to the lateral hollow was 1 mm or less, it was possible to supply a more stable heat amount in a few puffs after ignition since the burning position of the burning type heat source exceeded the lateral hollow in puffs after the first puff, and since a cylindrical portion which is capable of supplying a stable heat amount burned.

Experiment Result 3

In an experiment result 3, a sample not having a lateral hollow was prepared as Comparative Example 11 and 12. Further, as Examples 11 to 15, a plurality of samples with a different air inflow rate from the ignition end were prepared. In particular, the sample according to the Example 11 has four lateral hollows with a diameter of 2.0 mm (air inflow rate=28%). The sample according to the Example 12 has two lateral hollows with a diameter of 2.5 mm (air inflow rate=33%). The sample according to the Example 13 has four lateral hollows with a diameter of 1.5 mm (air inflow rate=40%). The sample according to the Example 14 has four lateral hollows with a diameter of 1.0 mm (air inflow rate=60%). The sample according to the Example 15 has two lateral hollows with a diameter of 1.0 mm (air inflow rate=75%).

A sample burning type heat source was ignited by an electrothermal lighter in the Comparative Example 11, in the same way as in the experiment results 1 and 2, and was ignited by a gas lighter in the Comparative Example 12 and Examples 11 to 15. A specific method of igniting by the gas lighter was to make a flame of a gas lighter contact an ignition end of the sample burning type heat source to perform preheating for 3 seconds, and then to inhale for 2 seconds with an inhalation capacity of 55 mL. In each of the Comparative Example 11 and 12 and Examples 11 to 15, the maximum temperature of gas flown into the paper tube holder from the burning type heat source in puffs at the time of ignition as described above was measured.

Figure 12:
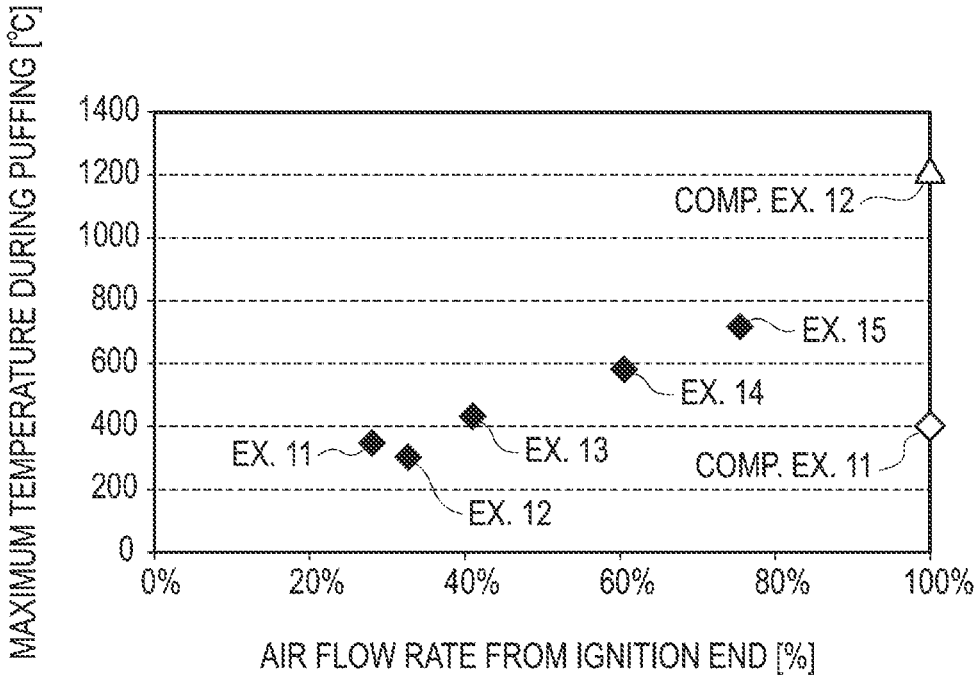
FIG. 12 is a drawing showing an experiment result 3.

FIG. 12 is a graph showing the experiment result 3. As shown in FIG. 12, in the Examples 11 to 15, it was confirmed that it was possible to decrease the maximum temperature of gas flown into the paper tube holder from the burning type heat source in puffs, as compared with the Comparative Example 12. That is, when the air inflow rate was 75% or less, it was confirmed that even when ignition was performed by the gas lighter, an inflow of the flame of the gas lighter was restrained, therefore it was possible to decrease the maximum temperature of inflow gas flown from the burning type heat source in puffs at the time of ignition.

Particularly, in the Examples 11 to 13, it was confirmed that it was possible to decrease the maximum temperature of the burning type heat source in puffs to the same extent as the Comparative Example 11. When the air inflow rate was 40% or less, it was confirmed that even when ignition was performed by the gas lighter, an inflow of the flame of the gas lighter to the paper tube holder was restrained to the same extent as a case where ignition was performed by an electrothermal lighter which does not cause the inflow of the flame, therefore it was possible to decrease the maximum temperature of inflow gas flown from the burning type heat source in puffs at the time of ignition.

Other Embodiments

The present invention is explained through the above-described embodiment, but it must not be assumed that this invention is limited by the statements and the drawings constituting a part of this disclosure. From this disclosure, various alternative embodiments, examples, and operational technologies will become apparent to those skilled in the art.

In the embodiment, the holder 30 houses the flavor source 32 formed in a columnar shape, which is formed by covering powdery and granular tobacco leaf with a sheet having air permeability. However, the embodiment is not limited thereto. The holder 30 may house a filter (hereinafter, referred to as "capsule filter") incorporating a capsule for housing menthol, etc. The capsule filter is arranged at a mouthpiece side relative to the flavor source 32. In such a case, the holder-side hollow 34 is preferably provided at an outer part of the capsule filter or at the ignition end 50Ae side relative to the outer part of the capsule filter in the second direction D2.

In the embodiment, in a state where the holder 30 holds the burning type heat source 50, the ignition end 50Ae of the burning type heat source 50 protrudes from the holder 30 and the lateral hollow 52 is exposed from the holder 30. However, the embodiment is not limited thereto. The holder 30 may be configured by a transparent member (such as glass), so that the lateral hollow 52 is visible through the holder 30.

In addition, the entire contents of Japanese Patent Application No. 2013-048092 (filed on Mar. 11, 2013), Japanese Patent Application No. 2013-048093 (filed on Mar. 11, 2013) and Japanese Patent Application No. 2013-048094 (filed on Mar. 11, 2013) are incorporated in the present specification by reference.

INDUSTRIAL APPLICABILITY

According to the present invention, it is possible to provide a burning type heat source and a flavor inhaler with which it is possible to achieve both of supplying a stable heat amount in a puff performed from the middle to the latter half and increasing a heat amount supplied in a few puffs after ignition.

The invention claimed is:

1. A burning type heat source, comprising:

a body made of a flammable material extending along a first direction from an ignition end toward a non-ignition end, a single longitudinal hollow extending through the flammable material along the first direction of the body; and a lateral hollow extending through the flammable material along a second direction crossing the first direction, the lateral hollow communicating with the longitudinal hollow, wherein the lateral hollow is provided closer to the ignition end in the first direction than the non-ignition end.

2. The heat source according to claim 1, wherein a distance from the ignition end to the lateral hollow in the first direction is less than 4 mm.

3. The heat source according to claim 1, wherein a distance from the ignition end to the lateral hollow in the first direction is 1 mm or less.

4. The heat source according to claim 1, wherein an area of the longitudinal hollow in cross section perpendicular to the first direction is 1.77 $mm^2$ or more.

5. The heat source according to claim 1, wherein an amount of inflow air from the longitudinal hollow at the ignition end is 40% or less of an amount of outflow air from the longitudinal hollow at the non-ignition end.

6. The burning type heat source according to claim 1, wherein the body has a cylindrical shape extending along the first direction, and wherein an outer diameter of the body is 3 mm or more and 15 mm or less.

7. The heat source according to claim 1, wherein a length of the body in the first direction is 5 mm or more and 30 mm or less.

8. A flavor inhaler including:

a heat source made of flammable material extending along a first direction from an ignition end toward a non-ignition end; and a holder holding the flammable heat source, wherein the flammable heat source comprises:

a single longitudinal hollow extending through the flammable material along the first direction; and a lateral hollow extending through the flammable material along a second direction crossing the first direction, the lateral hollow communicating with the longitudinal hollow, and wherein the lateral hollow is provided closer to the ignition end in the first direction than the non-ignition end.

9. A flavor inhaler including:

a heat source made of flammable material extending along a first direction from an ignition end toward a non-ignition end; and a holder holding the flammable heat source, wherein the flammable heat source comprises:

a longitudinal hollow extending through the flammable material along the first direction; and a lateral hollow extending through the flammable material along a second direction crossing the first direction, the lateral hollow communicating with the longitudinal hollow, and wherein the lateral hollow is configured to be visible from outside of the holder in the second direction.

10. The flavor inhaler according to claim 9, wherein the ignition end of the heat source protrudes from the holder, and wherein the lateral hollow is exposed from the holder.

11. The flavor inhaler according to claim 9, wherein a distance from the ignition end to the lateral hollow in the first direction is 5 mm or less.

12. The flavor inhaler according to claim 9, wherein a burning stop position is provided in the heat source at the non-ignition end side relative to the lateral hollow in the first direction, and wherein a distance from the lateral hollow to the burning stop position in the first direction is 5 mm or less.

13. The flavor inhaler according to claim 9, wherein an area of the longitudinal hollow in cross section perpendicular to the first direction is larger than an area of the lateral hollow in cross section perpendicular to the second direction.

14. The flavor inhaler according to claim 9, wherein an area of the longitudinal hollow in cross section perpendicular to the first direction is 1.77 $mm^2$ or more.

15. The flavor inhaler according to claim 9, wherein the heat source has a cylindrical shape extending along the first direction, and wherein an outer diameter of the heat source is 3 mm or more and 15 mm or less.

16. The flavor inhaler according to claim 9, wherein a length of the heat source in the first direction is 5 mm or more and 30 mm or less.

17. A flavor inhaler including:

a heat source made of flammable material extending along a first direction from an ignition end toward a non-ignition end; and a holder holding the flammable heat source; and a lateral hollow extending through the flammable material along a second direction crossing the first direction, the lateral hollow communicating with the longitudinal hollow, wherein the flammable heat source has a tubular shape including an outer wall that forms a single longitudinal hollow through the flammable material extending along the first direction, an area of the longitudinal hollow in cross section perpendicular to the first direction is 1.77 $mm^2$ or more, and an amount of inflow air from the longitudinal hollow at the ignition end is 75% or less of an amount of outflow air from a mouthpiece of the flavor inhaler.

18. The flavor inhaler according to claim 17, wherein the amount of inflow air from the longitudinal hollow at the ignition end is 40% or less of the amount of outflow air from the mouthpiece of the flavor inhaler.

19. The flavor inhaler according to claim 17, wherein the heat source comprises a lateral hollow extending along a second direction crossing the first direction, the lateral hollow communicating with the longitudinal hollow.

20. The flavor inhaler according to claim 17, wherein the holder has a holder-side hollow opening toward a second direction crossing the first direction.

21. The flavor inhaler according to claim 20, wherein the holder houses a flavor source, and wherein the holder-side hollow is provided at an outer part of the flavor source or at the ignition end side relative to the outer part of the flavor source in the second direction.

22. The flavor inhaler according to claim 20, wherein the holder houses a capsule filter, and wherein the holder-side hollow is provided at an outer part of the capsule filter or at the ignition end side relative to the outer part of the capsule filter in the second direction.

23. The flavor inhaler according to claim 17, wherein the heat source has a cylindrical shape extending along the first direction, and wherein an outer diameter of the heat source is 3 mm or more and 15 mm or less.

24. The flavor inhaler according to claim 17, wherein a length of the flammable heat source in the first direction is 5 mm or more and 30 mm or less.

* * * * *